US006072844A

United States Patent [19]

Inoue et al.

[11] Patent Number: 6,072,844

[45] Date of Patent: Jun. 6, 2000

[54] GAIN CONTROL IN POST FILTERING PROCESS USING SCALING

[75] Inventors: Akira Inoue; Yuji Maeda, both of Tokyo, Japan

[73] Assignee: Sony Corporation, Tokyo, Japan

[21] Appl. No.: 08/861,164

[22] Filed: May 21, 1997

[30] Foreign Application Priority Data

May 28, 1996 [JP] Japan ..... 8-156268

[51] Int. Cl.[7] ..... G10L 101/12

[52] U.S. Cl. ..... 375/345; 375/349; 375/350; 704/225; 455/235.1

[58] Field of Search ..... 375/345, 349, 375/350; 704/201, 225; 708/300; 455/235.1

[56] References Cited

U.S. PATENT DOCUMENTS 5,752,222 5/1998 Nishiguchi et al. ..... 704/201

*Primary Examiner*—Amanda T. Le
*Attorney, Agent, or Firm*—Jay H. Maioli

[57] ABSTRACT

A second post filter having characteristics similar to those of a first post filter used in the signal path is prepared and a gain of the first post filter is preliminarily presumed from an input and an output of the second post filter. An optimum scaling value when performing a filtering operation in the first post filter is set by using the gain obtained from the input and output of the second post filter, so that an optimum gain when controlling a gain fluctuation caused by the first post filter is set.

7 Claims, 13 Drawing Sheets

GAIN CONTROL IN POST FILTERING PROCESS USING SCALING

BACKGROUND OF THE INVENTION

1. Field of the Invention

The invention relates to a digital signal processing apparatus suitable for use in execution of a post filtering process to improve a quality of a decoded audio signal in a digital cellular phone.

2. Description of the Related Art

A VSELP (Vector Sum Excited Linear Prediction) technique has been used as an audio coding system in a digital cellular phone in North America and Japan. According to the VSELP system, an adaptive signal is formed from pitch information and a past exciting signal vector. A noise signal is formed by adding a basic vector. An exciting signal is formed by linearly adding the adaptive signal and the noise signal in accordance with a gain which is set in accordance with information indicative of a sound/soundless state. An audio signal is synthesized from the exciting signal by a short period synthesizing filter. A coding is performed by comparing the synthesized audio signal and an input audio signal, and selecting a code such that an error between them is minimum.

In the VSELP, therefore, a parameter $\alpha$ of the shortperiod synthesizing filter, an exciting source code I, pitch information L, and gains $\beta$ and $\gamma$ are transmitted. Upon decoding, the exciting signal is synthesized from a long period filtering state based on the pitch information L and the past exciting signal, an output of a code book based on the exciting source code I, and the gains $\beta$ and $\gamma$. The exciting signal is supplied to a predictive synthesizing filter of the parameter $\alpha$ and an audio signal is formed. Further, a post filter is used to improve an auditory impression. An auditory distortion is reduced by adaptively enhancing a pitch periodic component and enhancing a formant component.

That is, FIG. 1 shows a construction of a conventional decoder of the VSELP. In FIG. 1, reference numeral 151 denotes a long period filtering state. The long period filtering state 151 outputs a signal $b_L(n)$ based on a past exciting vector and the pitch information L from an input terminal 161. Reference numeral 152 denotes a code book. The code book 152 outputs a noise signal c(n) on the basis of the exciting source code I from an input terminal 162.

An output of the long period filtering state 151 is supplied to a multiplier 153 for multiplying the gain $\beta$ from an input terminal 163. An output of the code book 152 is supplied to a multiplier 154 to multiply the gain $\gamma$ from an input terminal 164. Outputs of the multipliers 153 and 154 are supplied to an adder 155. An exciting signal vector ex(n) is formed by the adder 155. The exciting signal vector is supplied to a short period synthesizing filter 156.

The parameter $\alpha$ from an input terminal 165 is set into the short period synthesizing filter 156. An audio signal is synthesized by the short period synthesizing filter 156. The audio signal is supplied to a post filter 157. The post filter 157 adaptively enhances the pitch periodic component and enhances the formant component. An output of the post filter 157 is taken out from an output terminal 158.

As mentioned above, according to the coding system like a VSELP, the post filter 157 is inserted upon decoding in order to reduce the auditory distortion. In case of realizing such a post filter 157 by a fixed point arithmetic operation, since a gain fluctuation value of a filtering process cannot be known before the filtering, as for a scaling of the filtering process, it is necessary to preliminarily set a slightly larger margin in consideration of a case where the gain becomes maximum. Therefore, when a signal to be filtered that is inputted to the post filter 157 is small and a gain of the filtering process is not so large, there is a problem such that an enough precision cannot be obtained in the filtering process.

That is, the exciting signal vector ex(n) is a linear sum based on sound/soundless information ($\beta$, $\gamma$) of the signal vector $b_L(n)$ which is formed on the basis of the pitch information L and the past exciting signal vector state and the noise signal c(n) from the code book and is expressed by $$e(X)=\beta b_L(n)+\gamma c(n) \tag{1}$$

By synthesizing it by the short period synthesizing filter 156, a decoded audio signal s(n) which is inputted to the post filter 157 is derived.

By the above equation (1), the exciting signal vector ex(n) is seen as if it is proportional to the signal vector $b_L(n)$ and noise signal c(n). However, the signal vector $b_L(n)$ and noise signal c(n) mutually exert an influence and are not mutually independent. The exciting signal vector ex(n) is fed back to a long period filtering state r(n) and, as shown in FIG. 2, it is expressed as follows.

$$r(n)=r(n+N)\ (0\leqq n<L_{max}-N)$$

$$r(L_{max}-N+n)=ex(n)$$

The long period filter output $b_L(n)$ is obtained as follows from the pitch information L.

$$b_L(n)=r(L_{max}-L+n)\ (0\leqq n\leqq N)$$

where,

N: signal vector length $L_{max}$: past exciting signal vector state $b_L(n)$ is obtained from the signal ex(n). The long period filter output $b_L(n)$ and exciting signal ex(n) are not proportional.

If the gain fluctuation value by the filtering process in the post filter 157 is known before the filtering process, the scaling of the filtering process can be set to an optimum value when operating the post filter 157 by a fixed point arithmetic operation from the gain fluctuation value, and a precision can be improved. Since the gain fluctuation occurs by transmitting the signal through the post filter 157, it is considered to provide a gain control circuit at the post stage of the post filter 157. If the gain fluctuation value of the filtering process is known before the filtering process, by using the gain fluctuation value of the filter, a gain of the gain control circuit at the post stage of the post filter 157 can be optimally set.

OBJECTS AND SUMMARY OF THE INVENTION

It is, therefore, an object of the invention to provide a digital signal processing apparatus which can perform an optimum scaling by previously knowing a gain fluctuation value caused by a post filter and can improve a precision of the post filter.

Another object of the invention is to provide a digital signal processing apparatus which can optimally set a fluctuation of a gain occurring by a post filter by previously knowing the gain fluctuation value caused by the post filter.

According to the invention, there is provided a digital signal processing apparatus comprising: first filter means to which a filtering signal is supplied; scaling means for performing a scaling process to a filter operation in the first filtering means; gain control means for correcting a gain fluctuation caused by the first filtering means; second filter means which has characteristics similar to those of the first filter means and to which a pseudo filtering signal is supplied; and gain operating means for obtaining a gain of the second filtering means from an input signal to the second filter means and an output signal thereof, wherein a scaling value of the scaling means and a gain correction value of the gain control means are controlled by using the gain of the second filter means obtained by the gain operating means.

According to the invention, there is provided a digital signal processing apparatus comprising: first synthesizing filer means for synthesizing an audio signal from an exciting signal; first post filter means for filtering an output of the first synthesizing filter means; scaling means for performing a scaling process to a filter operation in the first post filter means; gain control means for correcting a gain fluctuation occurring in the first post filter means; second synthesizing filter means which has characteristics similar to those of the first synthesizing filter means and synthesizes a pseudo signal from a pseudo exciting signal; second post filter means which has characteristics similar to those of the first filter means and filters an output of the second synthesizing filter means; and gain operating means for obtaining a gain of the second post filter means from an input signal to the second post filter means and an output signal thereof, wherein a scaling value of the scaling means and a gain correction value of the gain control means are controlled by using the gain of the second post filter means obtained by the gain operating means.

Another filter having characteristics similar to those of the post filter for processing the decoded audio signal is prepared. The gain of the post filter for processing the audio signal can be previously presumed by such another filter. Therefore, in the case where the filter operation in the post filter for processing the audio signal is performed by a fixed point arithmetic operation, the optimum scaling can be performed. By using the gain obtained as mentioned above, the fluctuation of the gain occurring by the post filter can be optimally corrected.

The above and other objects and features of the present invention will become apparent from the following detailed description and the appended claims with reference to the accompanying drawings.

DETAILED DESCRIPTION OF THE PREFERRED EMBODIMENTS

Figure 1:
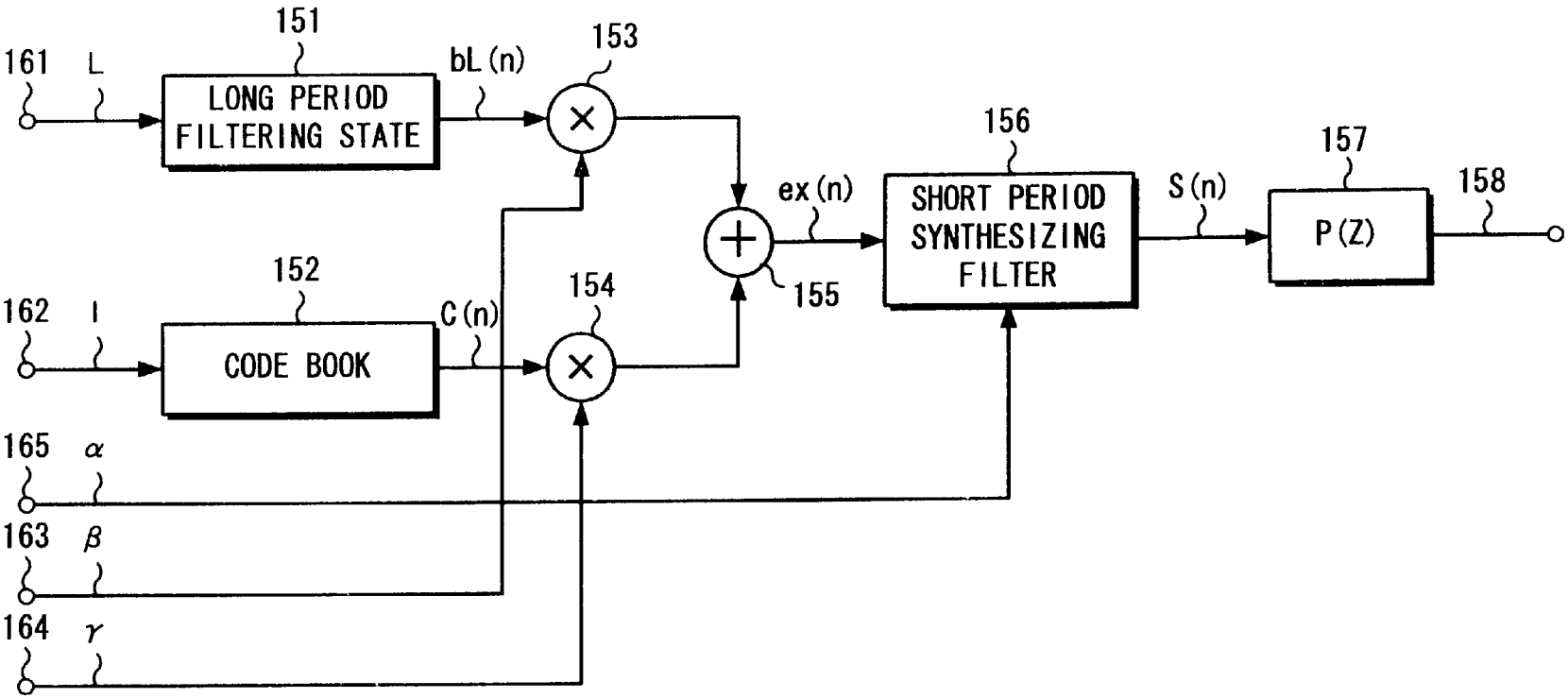
Fig. 1 (PRIOR ART)
FIG. 1 is a block diagram of an example of a conventional VSELP demodulator.
Figure 2:
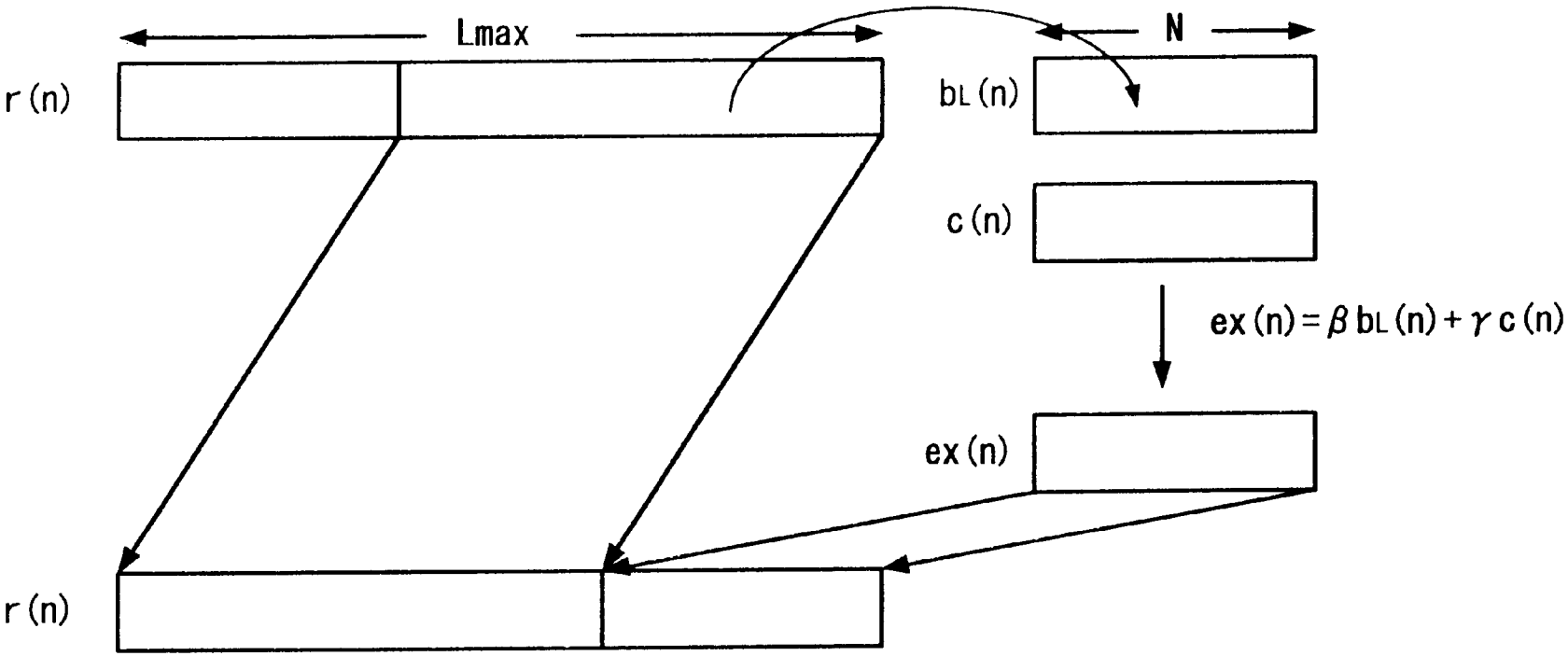
Fig. 2 (PRIOR ART)
FIG. 2 is a schematic diagram for use in the explanation of the conventional VSELP demodulator.
Figure 3:
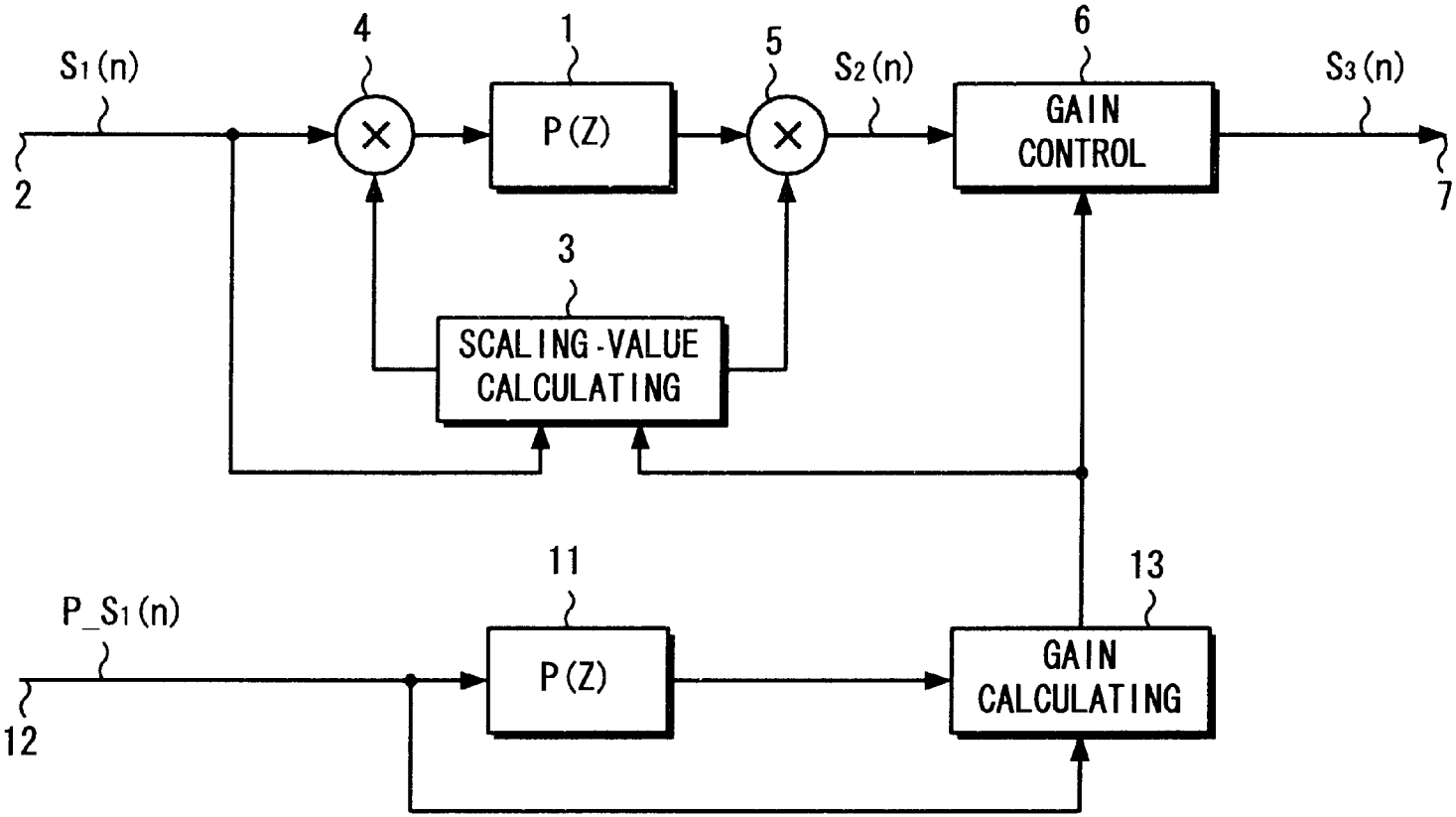
FIG. 3 is a block diagram showing the first embodiment of the invention.

An embodiment of the invention will now be described hereinbelow with reference to the drawings. FIG. 3 shows a fundamental construction of the invention. In FIG. 3, it is now assumed that a filtering process is performed in a filter 1 by a fixed point arithmetic operation. If a gain fluctuation value caused by the filter 1 is known in this case, a word length can be effectively used by a scaling process and a filter operating process of a high precision can be performed. Therefore, a scaling value calculating circuit 3 and shifting circuits 4 and 5 are provided for executing the filtering operation of the filter 1 by scaling processing.

When a gain fluctuation occurs in the filter 1, if the gain fluctuation in the filter 1 is known, a gain which corresponds to the gain fluctuation in the filter 1 and is in the reverse direction of that of such a gain is added to the post stage of the filter 1, so that the gain fluctuation in the filter 1 can be compensated. A gain control circuit 6 is provided in order to compensate the gain fluctuation caused by the filter 1 as mentioned above.

The gain of the filter 1 can be obtained from the input signal to the filter 1 and an output signal thereof. However, when an adaptive type process in which its coefficients are not fixed is performed in the filter 1, such an arithmetic operation can be derived only after the filter operation was completed in the filter 1. On the other hand, in order to perform the optimum scaling, it is necessary to presume the gain of the filter 1 before the filter operation in the filter 1 is completed.

For this purpose, a filter 11 having characteristics similar to those of the filter 1 is prepared and the gain of the filter 1 is presumed by using the filter 11 before the filter operation in the filter 1 is finished. By using the gain presumed by using the filter 11, the optimum scaling can be performed in case of executing the scaling process to the arithmetic operation of the filter 1. The optimum gain compensation can be also performed in case of performing a gain compensation by the gain control circuit 6.

That is, in FIG. 3, a signal $s_1(n)$ to be filtered is supplied to an input terminal 2. The signal $s_1(n)$ from the input terminal 2 is shifted by the shifting circuit 4 on the basis of a scaling value from the scaling value calculating circuit 3. An output of the shifting circuit 4 is supplied to the post filter 1. A filtering operation is performed to the signal $s_1(n)$ by the filter 1. An output of the filter 1 is supplied to the shifting circuit 5. The shifting circuit 5 shifts the bits in correspondence to the shift amount in the shifting circuit 4 in the reverse direction of the shifting direction. An output $s_2(n)$ of the shifting circuit 5 is supplied to the gain control circuit 6. The gain fluctuation in the filter 1 is compensated by the gain control circuit 6. An output $s_3(n)$ of the gain control circuit 6 is outputted from an output terminal 7.

A pseudo filtering signal $p_s_1(n)$ is supplied to an input terminal 12. The pseudo filtering signal $p_s_1(n)$ is supplied to the filer 11 and to a gain calculating circuit 13. An output $p_s_2(n)$ of the filter 11 is supplied to the gain calculating circuit 13.

The gain calculating circuit 13 calculates a gain fluctuation G by the filter 11 as $$G=\alpha_2(n)/\alpha_1(n)$$

from a value $\alpha_1(n)$ that is proportional to the input signal vector $p_s_1(n)$ of the filter 11 and a value amplitude $\alpha_2(n)$ that is proportional to the output signal vector $p_s_2(n)$ of the filter 11.

The filter 11 has characteristics similar to those of the post filter 1. Therefore, the gain of the filter 11 obtained by the gain calculating circuit 13 corresponds to the gain of the filter 1. Therefore, by using the gain obtained by the gain calculating circuit 13, the gain corresponding to the gain of the post filter 1 can be preliminarily obtained prior to performing the filter operation in the filter 1.

The gain obtained by the gain calculating circuit 13 is supplied to the scaling value calculating circuit 3. Thus, the scaling when the filtering operation is performed in the filter 1 is optimally carried out. That is, as the gain obtained by the gain calculating circuit 13 is larger, a scaling value K is set to a smaller value.

The gain obtained by the gain calculating circuit 13 is also supplied to the gain control circuit 6. The gain fluctuation of the filter 1 is compensated by the gain control circuit 6. That is, a gain is multiplied by the gain control circuit 6 so as to compensate the gain obtained by the gain calculating circuit 13.

As mentioned above, when the gain fluctuation by the filter 1 is not known, by preparing the filter 11 with characteristics similar to those of the filter 1, the gain corresponding to the gain by the filter 1 can be preliminarily presumed. On the basis of such a fundamental principle, a construction of a decoder of an audio signal which can perform the optimum scaling for the post filter and can compensate the gain fluctuation occurring by the post filter will now be examined.

Figure 4:
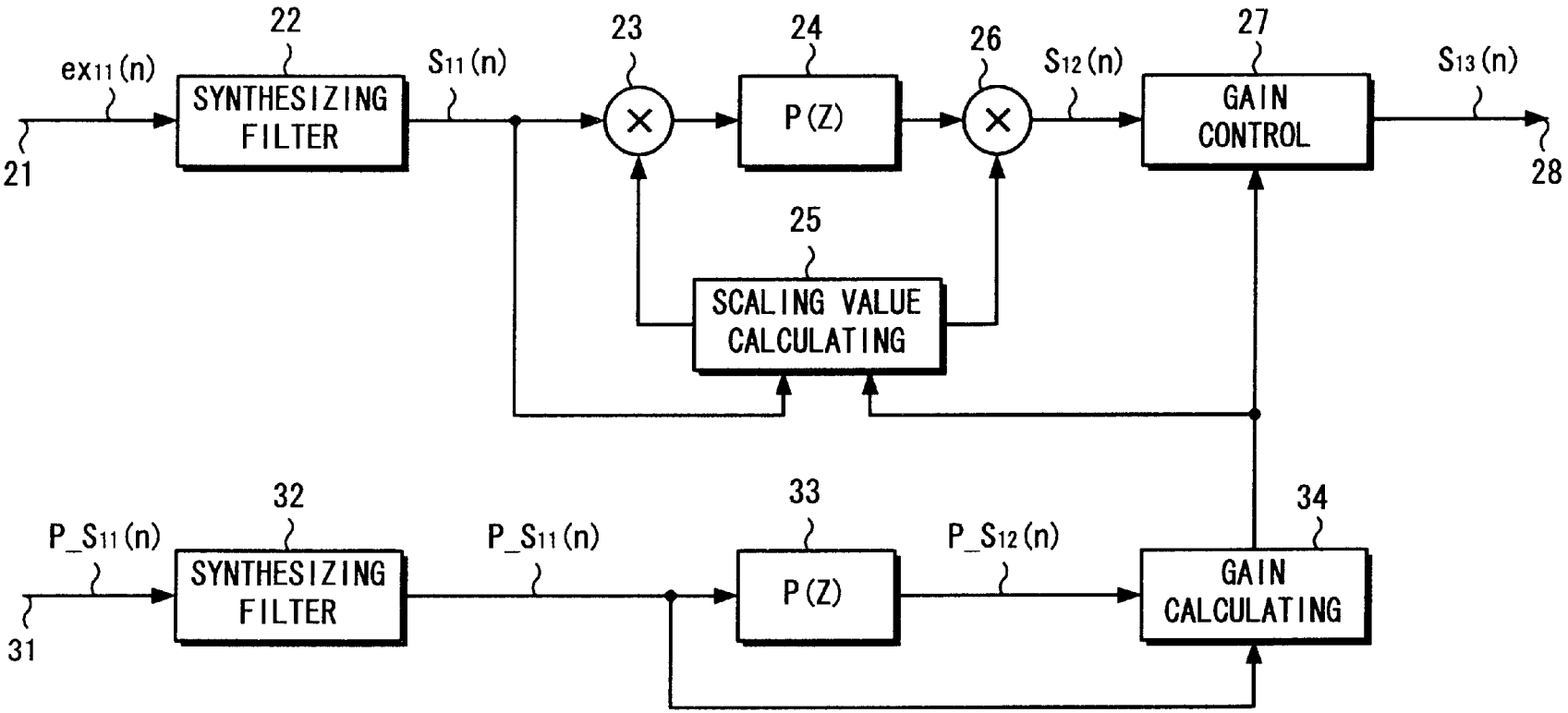
FIG. 4 is a block diagram showing the second embodiment of the invention.
Figure 5:
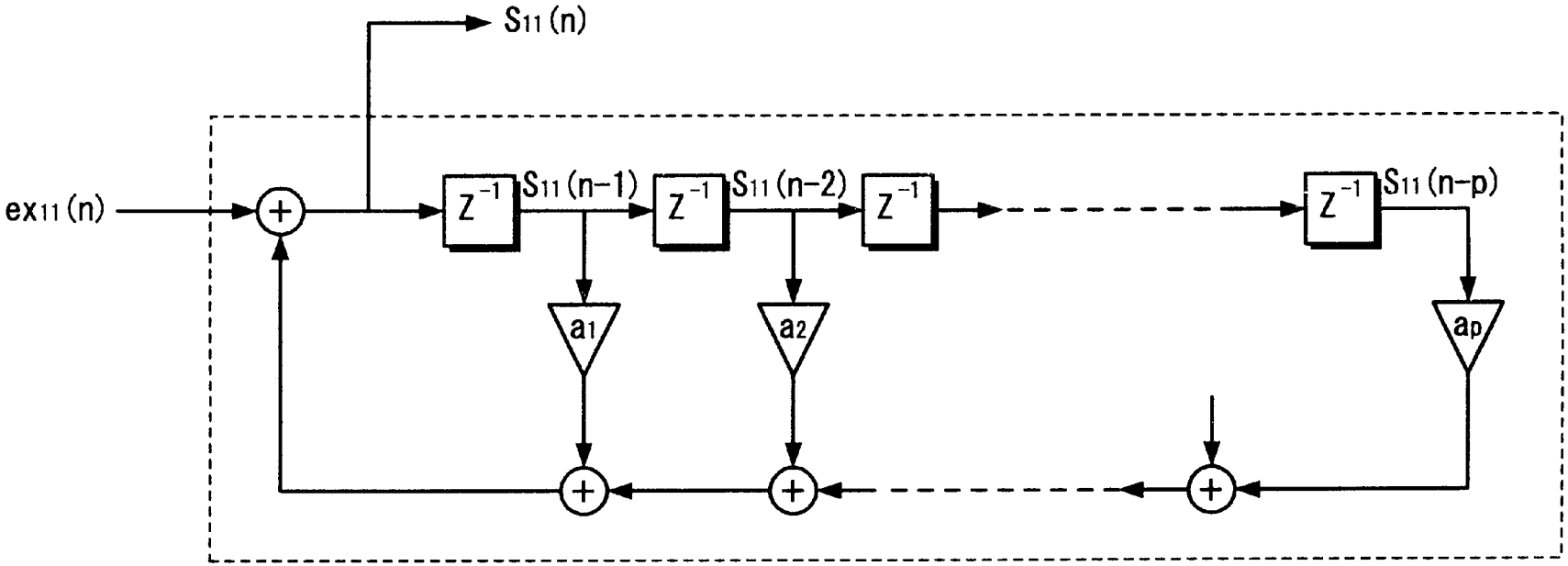
FIG. 5 is a block diagram of an example of a synthesizing filter.
Figure 6:
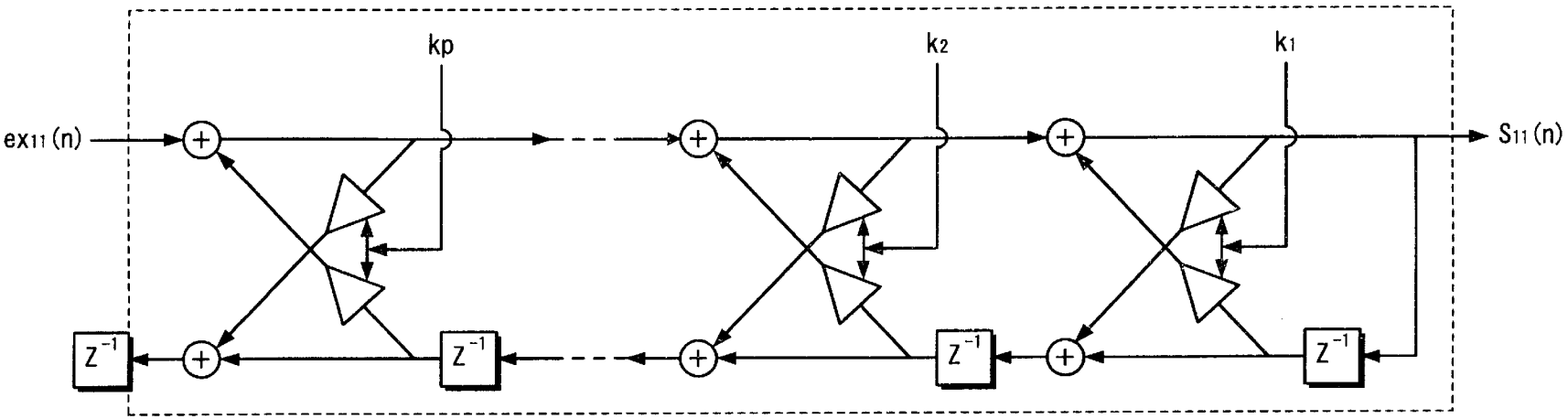
FIG. 6 is a block diagram of another example of a synthesizing filter.
Figure 7:
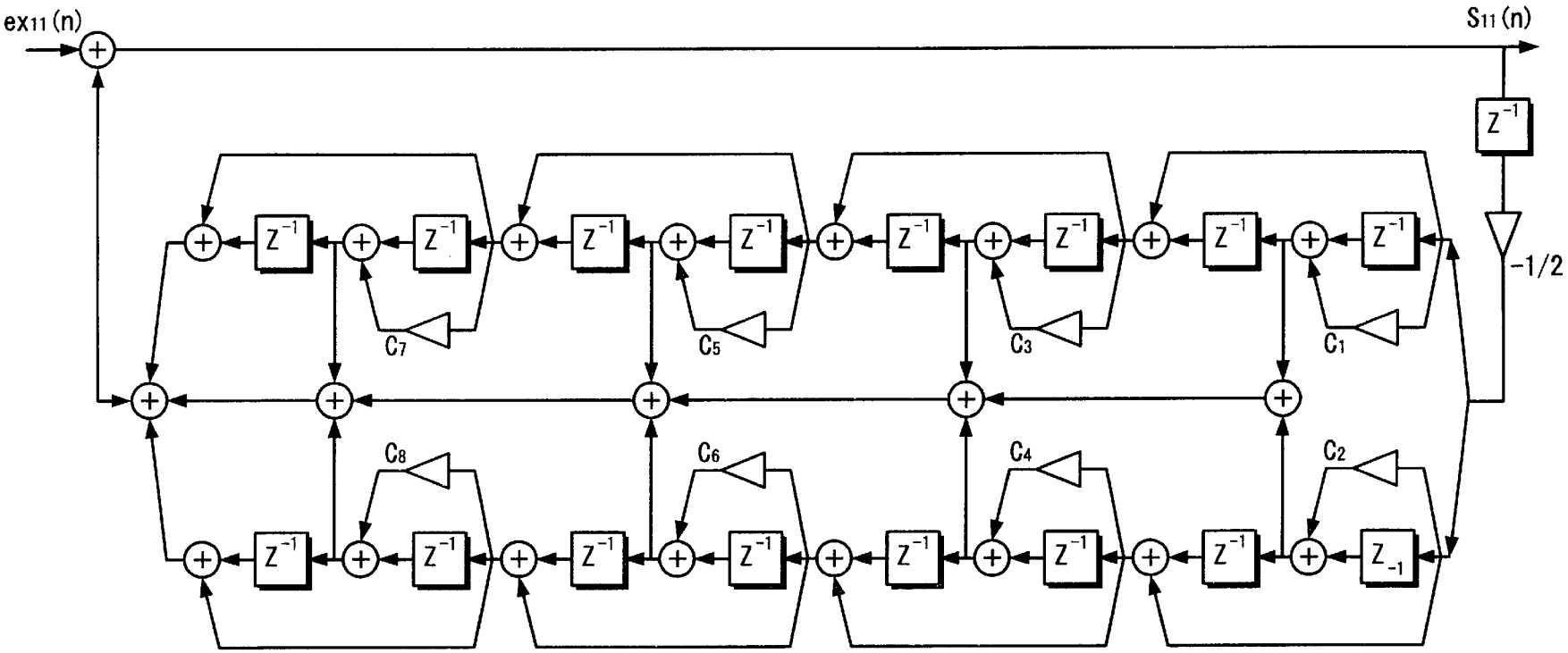
FIG. 7 is a block diagram of still another example of a synthesizing filter.

A construction in a case where an audio signal can be synthesized by a synthesizing filter for the exciting signal is shown in FIG. 4. As a synthesizing filter 22, a linear predictive coefficient filter (LPC) as shown in FIG. 5, a partial autocorrelation (PARCOR) coefficient filter as shown in FIG. 6, a linear spectral pair (LSP) coefficient filter as shown in FIG. 7, or the like is used.

According to such a construction, as shown in FIG. 4, by providing the synthesizing filter 22 with an exciting signal $ex_{11}(n)$, an audio signal $s_{11}(n)$ is derived. A quality of audio signal is improved by providing a post filter 24 to the audio signal $s_{11}(n)$.

In case of performing a filter operation of the post filter 24 by a fixed point arithmetic operation, if a gain fluctuation value occurring by the post filter 24 is known, a word length can be effectively used by the scaling process. The filtering operating process with a high precision can be performed. Therefore, a scaling value calculating circuit 25 and shifting circuits 23 and 26 are provided in order to perform the filtering operation of the post filter 24 by executing the scaling process to it.

When the gain fluctuation occurs by the post filter 24, so long as the gain fluctuation in the post filter 24 is known, the gain which corresponds to the gain fluctuation of the post filter 24 and is in the reverse direction of that of such a gain is added to the post stage of the post filter 24, so that the gain fluctuation in the post filter 24 can be compensated. A gain control circuit 27 is provided to compensate the gain fluctuation occurring by the post filter 24.

A synthesizing filter 32 having characteristics similar to those of the synthesizing filter 22 and a post filter 33 having characteristics similar to those of the post filter 24 are provided to presume the gain in the post filter 24. A pseudo exciting signal $p_ex_{11}(n)$ is supplied to the synthesizing filter 32, thereby obtaining a pseudo audio signal $p_s_{11}(n)$. The pseudo audio signal $p_s_{11}(n)$ is supplied to the post filter 33 and a gain of the post filter 33 is obtained by using an input signal and an output signal of the post filter 33, thereby presuming the gain of the post filter 24. By using the gain presumed by using the post filter 33, the optimum scaling can be carried out in case of executing the operation of the post filter 24 by the scaling process. The optimum gain compensation can be also performed when executing the gain compensation by the gain control circuit 27.

That is, in FIG. 4, the exciting signal $ex_{11}(n)$ is supplied to an input terminal 21. The exciting signal $ex_{11}(n)$ from the input terminal 21 is supplied to the synthesizing filter 22. The audio signal $s_{11}(n)$ is synthesized from the exciting signal $ex_{11}(n)$ by the synthesizing filter 11. The signal $s_{11}(n)$ is supplied to the shifting circuit 23. The signal $s_{11}(n)$ synthesized by the synthesizing filter 22 is shifted by the shifting circuit 23 on the basis of the scaling value from the scaling value calculating circuit 25. An output of the shifting circuit 23 is supplied to the post filter 24. A filtering operation is performed to the signal $s_{11}(n)$ from the synthesizing filter 22 by the post filter 24. The filtering operation in the post filter 24 is realized by a fixed point arithmetic operation. The output of the post filter 24 is supplied to the shifting circuit 26. The shifting circuit 26 shifts the signal in correspondence to the shift amount in the shifting circuit 23 in the reverse direction of the shifting direction. An output $s_{12}(n)$ of the shifting circuit 26 is supplied to the gain control circuit 27. The gain control circuit 27 is used to compensate the gain fluctuation caused by the post filter 24. An output $s_{13}(n)$ of the gain control circuit 27 is outputted from an output terminal 28.

The pseudo exciting circuit $p_ex_{11}(n)$ is supplied from an input terminal 31. The pseudo exciting signal $p_ex_{11}(n)$ is supplied to the synthesizing filter 32. The synthesizing filter 32 has a construction similar to that of the synthesizing filter 22. The pseudo audio signal $p_s_{11}(n)$ is synthesized by the synthesizing filter 32. An output of the synthesizing filter 32 is supplied to the post filter 33 and to a gain calculating circuit 34. An output of the post filter 33 is supplied to the gain calculating circuit 34. The post filter 33 has characteristics similar to those of the post filter 24.

The gain calculating circuit 34 calculates a gain fluctuation by the filter 33 from a value that is proportional to the input signal vector $p_s_{11}(n)$ of the post filter 33 and a value that is proportional to an output signal vector $p_s_{12}(n)$ of the filter 33.

The synthesizing filter 32 has characteristics similar to those of the synthesizing filter 22. The post filter 33 has characteristics similar to those of the post filter 24. Therefore, the gain of the post filter 33 obtained by the gain calculating circuit 34 corresponds to the gain of the post filter 24.

The gain obtained by the gain calculating circuit 34 is supplied to the scaling value calculating circuit 25. Thus, the scaling when the filtering operation is performed in the post filter 24 is optimally carried out. The gain obtained by the gain calculating circuit 34 is supplied to the gain control circuit 27. The gain fluctuation of the post filter 24 is compensated by the gain control circuit 27.

A case where an exciting signal vector is expressed by a linear sum of an output of an impulse sequence generator based on the pitch information and sound/soundless information of an output of a white noise generator will now be examined.

Figure 8:
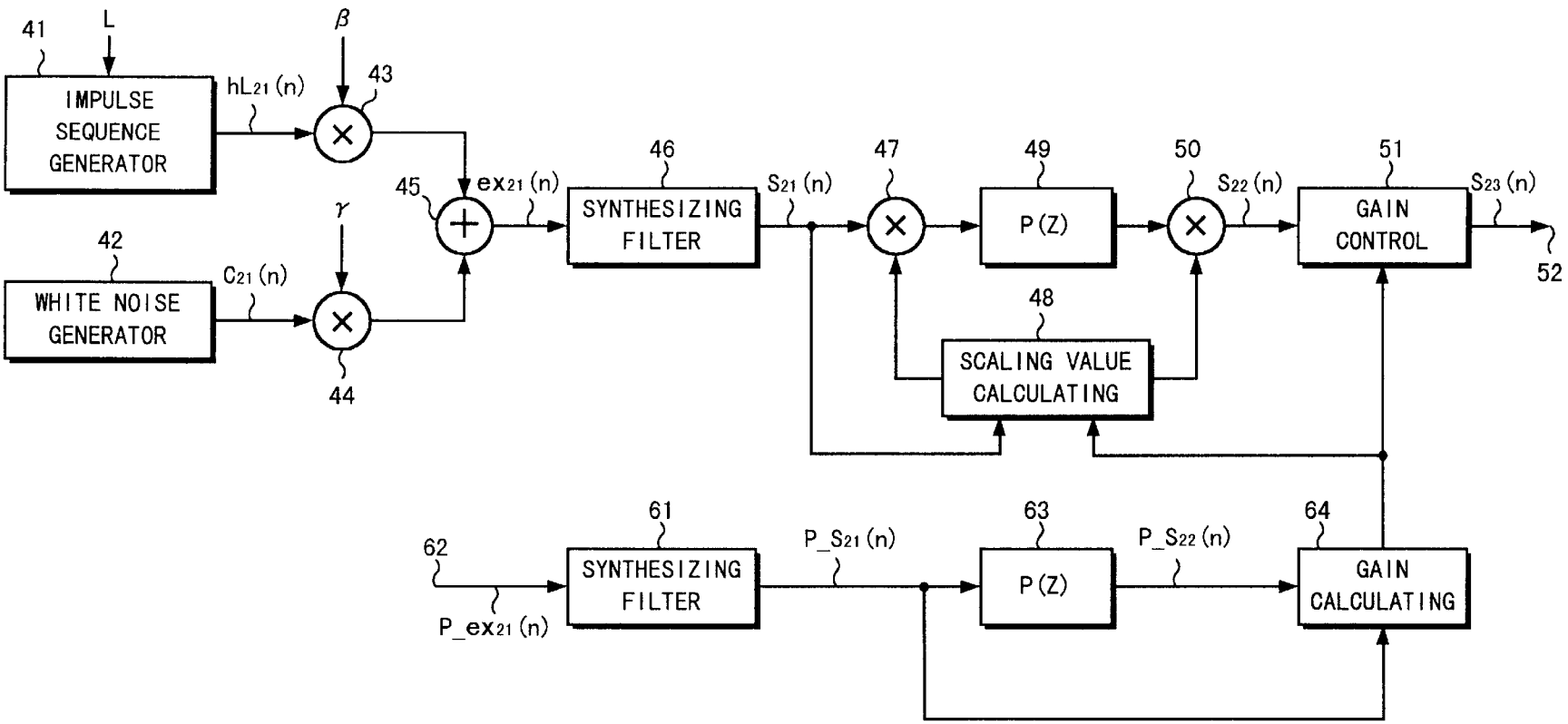
FIG. 8 is a block diagram showing the third embodiment of the invention.

As shown in FIG. 8, it is assumed that an exciting signal $ex_{21}(n)$ is shown by a linear sum $$ex_{21}(n)=\beta b_L(n)+\gamma c(n)$$

of the sound/soundless information (β, γ) of an impulse signal $h_{L21}(n)$ of an impulse sequence generator 41 for generating an impulse sequence based on the pitch information L and a noise signal $c_{21}(n)$ from a white noise generator 42. An audio signal $s_{21}(n)$ is derived by providing a synthesizing filter 46 for the exciting signal $ex_{21}(n)$ which is obtained as mentioned above. A quality of the audio signal is improved by providing a post filter 49 for the audio signal $s_{21}(n)$.

In case of performing a filtering operation of the post filter 49 by a fixed point arithmetic operation, if a gain fluctuation value occurring by the post filter 49 is known, a word length can be effectively used by a scaling process and a filtering operating process with a high precision can be carried out. A scaling value calculating circuit 48 and shifting circuits 47 and 50 are provided to execute a filtering operation of the post filter 49 by executing a scaling process.

When a gain fluctuation occurs by the post filter 49, if the gain fluctuation in the post filter 49 is known, a gain which corresponds to the gain fluctuation in the post filter 49 and is in the reverse direction of that of such a gain is added to the post stage of the post filter 49, so that the gain fluctuation in the post filter 49 can be compensated. A gain control circuit 51 is provided to compensate the gain fluctuation occurring by the post filter 49 as mentioned above.

A synthesizing filter 61 having characteristics similar to those of the synthesizing filter 46 and a post filter 63 having characteristics similar to those of the post filter 49 are provided in order to presume the gain in the post filter 49. A pseudo audio signal $p_s_{21}(n)$ is obtained by supplying a pseudo exciting signal $p_es_{21}(n)$ to the synthesizing filter 61. The pseudo audio signal $p_s_{21}(n)$ is supplied to the filter 63 and a gain of the filter 63 is obtained by using an input signal and an output signal of the filter 63, thereby presuming the gain of the post filter 49. By using the gain presumed by using the filter 63, the optimum scaling can be performed when executing an arithmetic operation of the post filter 49 by the scaling process. The optimum gain compensation can be carried out in case of performing the gain compensation by the gain control circuit 51.

That is, in FIG. 8, the impulse sequence signal $h_{L21}(n)$ based on the pitch information L is generated from the impulse sequence generator 41. An output of the impulse sequence generator 41 is supplied to a multiplier 43 for multiplying the gain β indicative of the sound/soundless information. An output of the multiplier 43 is supplied to an adder 45.

The white noise generator 42 generates the noise signal $c_{21}(n)$. An output of the white noise generator 42 is supplied to a multiplier 44 for multiplying the gain γ indicative of the sound/soundless information. An output of the multiplier 44 is supplied to the adder 45.

An exciting signal vector $ex_{21}(n)$ is formed by the adder 45. The exciting signal vector $ex_{21}(n)$ is expressed by $$ex_{21}(n)=\beta h_{L21}(n)+\gamma c_{21}(n)$$

The exciting signal vector $ex_{21}(n)$ is supplied to the synthesizing filter 46. An audio signal is synthesized by the synthesizing filter 46.

The signal $s_{21}(n)$ synthesized by the synthesizing filter 46 is supplied to the shifting circuit 47. The audio signal synthesized by the synthesizing filter 46 is shifted by the shifting circuit 47 on the basis of the scaling value from the scaling value calculating circuit 48. An output of the shifting circuit 47 is supplied to the post filter 49. The post filter 49 executes a process to improve a sound quality. A filtering operation is performed by the post filter 49 to the signal from the synthesizing filter 46. The filtering operation in the post filter 49 is realized by a fixed point arithmetic operation. An output of the post filter 49 is supplied to the shifting circuit 50. The shifting circuit 50 shifts the bits in accordance with the shift amount in the shifting circuit 47 in the reverse direction of the shifting direction. An output $s_{22}(n)$ of the shifting circuit 50 is supplied to the gain control circuit 51. The gain control circuit 51 compensates the gain fluctuation occurring by the post filter 49. An output $s_{23}(n)$ of the gain control circuit 51 is outputted from an output terminal 52.

The synthesizing filter 61 has a construction similar to that of the synthesizing filter 46. The pseudo exciting signal $p_ex_{21}(n)$ is supplied from an input terminal 62 to the synthesizing filter 61. The pseudo audio signal $p_s_{21}(n)$ is synthesized by the synthesizing filter 61. The pseudo audio signal $p_s_{21}(n)$ is supplied to the post filter 63 and to a gain calculating circuit 64. An output of the post filter 63 is supplied to the gain calculating circuit 64. The post filter 63 has characteristics similar to those of the post filter 49.

The gain calculating circuit 64 calculates the gain by the filter 63 from a value that is proportional to the input signal vector $p_s_{21}(n)$ of the post filter 63 and a value that is proportional to an output signal vector $p_s_{22}(n)$ of the post filter 63.

The synthesizing filter 61 has characteristics similar to those of the synthesizing filter 46. The post filter 63 has characteristics similar to those of the post filter 49. Therefore, the gain of the post filter 63 obtained by the gain calculating circuit 64 corresponds to the gain of the post filter 49.

The gain obtained by the gain calculating circuit 64 is supplied to the scaling value calculating circuit 48. Thus, the scaling when the filtering operation is performed in the post filter 49 is optimally carried out. The gain obtained by the gain calculating circuit 64 is supplied to the gain control circuit 51. The gain fluctuation of the post filter 49 is compensated by the gain control circuit 51.

An example in the case where the exciting signal vector is expressed by a linear sum of the sound/soundless information of the past exciting signal vector state based on the pitch information and the noise signal will now be examined.

Figure 9:
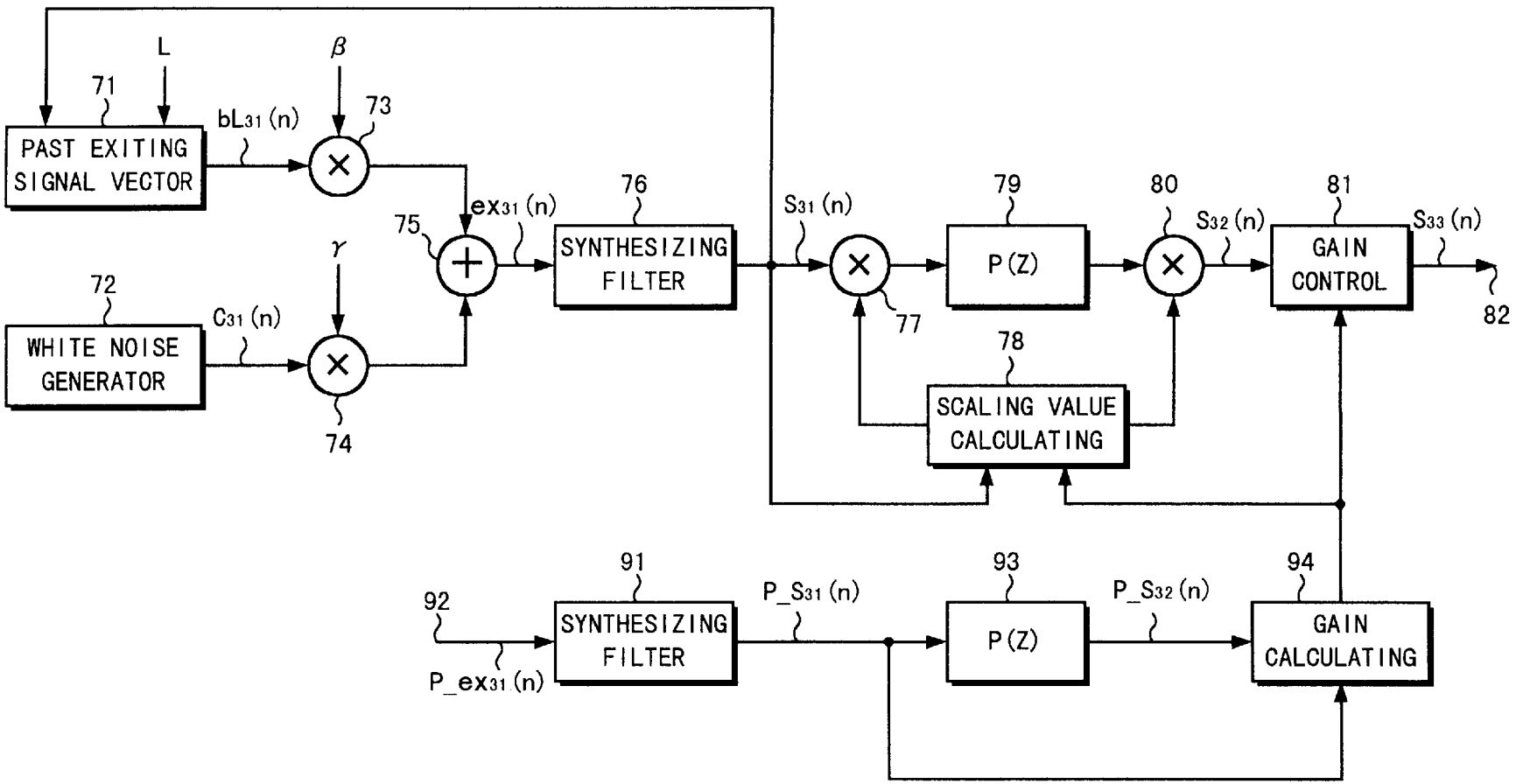
FIG. 9 is a block diagram showing the fourth embodiment of the invention.

As shown in FIG. 9, it is now assumed that an exciting signal $ex_{31}(n)$ is shown by a linear sum $$ex_{31}(n)=\beta b_{L31}(n)+\gamma c_{31}(n)$$

of the sound/soundless information (β, γ) of a signal vector $b_{L31}(n)$ that is formed by the pitch information L and the past exciting signal vector state and a noise signal $c_{31}(n)$ from a white noise generator 72. An audio signal $s_{31}(n)$ is obtained by providing a synthesizing filter 76 for the exciting signal $ex_{31}(n)$ which is obtained as mentioned above. A quality of the audio signal is improved by providing a post filter 79 for the audio signal $s_{31}(n)$.

In case of performing a filtering operation of the post filter 79 by a fixed point arithmetic operation, if a gain fluctuation value occurring by the post filter 79 is known, a word length can be effectively used by the scaling process and a filtering operating process of a high precision can be performed. Therefore, a scaling value calculating circuit 78 and shifting circuits 77 and 80 are provided to execute the filtering operation of the post filter 79 by performing the scaling process.

When the gain fluctuation occurs by the post filter 79, if the gain fluctuation of the post filter 79 is known, a gain which corresponds to the gain fluctuation in the post filter 79 and is in the reverse direction of that of such a gain is added to the post stage of the post filter 79, so that the gain fluctuation in the post filter 79 can be compensated. A gain control circuit 81 is provided to compensate the gain fluctuation occurring by the post filter 79 as mentioned above.

A synthesizing filter 91 having characteristics similar to those of the synthesizing filter 76 and a post filter 93 having characteristics similar to those of the post filter 79 are provided to presume the gain in the post filter 79. A pseudo audio signal $p_s_{31}(n)$ is obtained by supplying a pseudo exciting signal $p_ex_{31}(n)$ to the synthesizing filter 91. The pseudo audio signal $p_s_{31}(n)$ is supplied to the post filter 93 and a gain of the post filter 93 is obtained by using an input signal and an output signal of the post filter 93, thereby presuming the gain of the post filter 79. By using the gain presumed by using the post filter 93, the optimum scaling can be performed in case of executing the operation of the post filter 79 by the scaling process. The optimum gain compensation can be carried out in case of performing the gain compensation by the gain control circuit 81.

That is, in FIG. 9, a signal $b_{L31}$ is generated from a signal generator 71 on the basis of the pitch information L and the past exciting signal vector state. The signal $b_{L31}$ is supplied to a multiplier 73 for multiplying the gain β indicative of the sound/soundless information. An output of the multiplier 73 is supplied to an adder 75.

The noise signal $c_{31}(n)$ is generated from the white noise generator 72. The noise signal is supplied to a multiplier 74 to be multiplied with the gain γ indicative of the sound/soundless information. An output of the multiplier 74 is supplied to the adder 75.

The exciting signal vector $ex_{31}(n)$ is formed by the adder 75. The exciting signal vector $ex_{31}(n)$ is expressed as $$ex_{31}(n)=\beta b_{L31}(n)+\gamma c_{31}(n)$$

The exciting signal vector $ex_{31}(n)$ is supplied to the synthesizing filter 76. An audio signal $s_{31}(n)$ is synthesized by the synthesizing filter 76.

The audio signal $s_{31}(n)$ synthesized by the synthesizing filter 76 is supplied to the shifting circuit 77. The audio signal synthesized by the synthesizing filter 76 is shifted by the shifting circuit 77 on the basis of the scaling value from the scaling value calculating circuit 78. An output of the shifting circuit 77 is supplied to the post filter 79. The post filter 79 executes a process to improve the sound quality. A filtering operation is performed by the post filter 79 to the signal from the synthesizing filter 76. The filtering operation in the post filter 79 is realized by a fixed point arithmetic operation. An output of the post filter 79 is supplied to the shifting circuit 80. The shifting circuit 80 shifts the bits in accordance with the shift amount in the shifting circuit 77 in the reverse direction of the shifting direction. An output $s_{32}(n)$ of the shifting circuit 80 is supplied to the gain control circuit 81. The gain control circuit 81 compensates the gain fluctuation occurring by the post filter 79. An output $s_{33}(n)$ of the gain control circuit 81 is outputted from an output terminal 82.

The synthesizing filter 91 has a construction similar to that of the synthesizing filter 76. The pseudo exciting signal $p_ex_{31}(n)$ is supplied from an input terminal 92 to the synthesizing filter 91. The pseudo audio signal $p_{s31}(n)$ is synthesized by the synthesizing filter 91. The pseudo audio signal $p_s_{31}(n)$ is supplied to the post filter 93 and to a gain calculating circuit 94. An output of the post filter 93 is supplied to the gain calculating circuit 94. The post filter 93 has characteristics similar to those of the post filter 79.

The gain calculating circuit 94 calculates a gain by the post filter 93 from a value that is proportional to the input signal vector $p_s_{31}(n)$ of the post filter 93 and a value that is proportional to an output signal vector $p_s_{32}(n)$ of the post filter 93.

The synthesizing filter 91 has characteristics similar to those of the synthesizing filter 76. The post filter 93 has characteristics similar to those of the post filter 79. Therefore, the gain of the post filter 93 obtained by the gain calculating circuit 94 corresponds to the gain of the post filter 79.

The gain obtained by the gain calculating circuit 94 is supplied to the scaling value calculating circuit 78. Thus, the scaling when the filtering operation is performed by the post filter 79 is optimally executed. The gain obtained by the gain calculating circuit 94 is supplied to the gain control circuit 81, so that the gain fluctuation of the post filter 79 is compensated.

In FIG. 9, it is desirable that the pseudo exciting signal $p_ex_{31}(n)$ which is supplied to the synthesizing filter 91 is similar to the exciting signal $ex_{31}(n)$ which is supplied to the synthesizing filter 76. However, the exciting signal $ex_{31}(n)$ is shown by a linear sum $$ex_{31}(n)=\beta b_{L31}(n)+\gamma c_{31}(n)$$

of the sound/soundless information (β, γ) of the signal vector $b_{L31}(n)$ which is formed by the pitch information L and the past exciting signal vector state and the noise signal $c_{31}(n)$ from the white noise generator 42. It is difficult to form the pseudo exciting signal $p_ex_{31}(n)$ similar to the exciting signal $ex_{31}(n)$.

Figure 10:
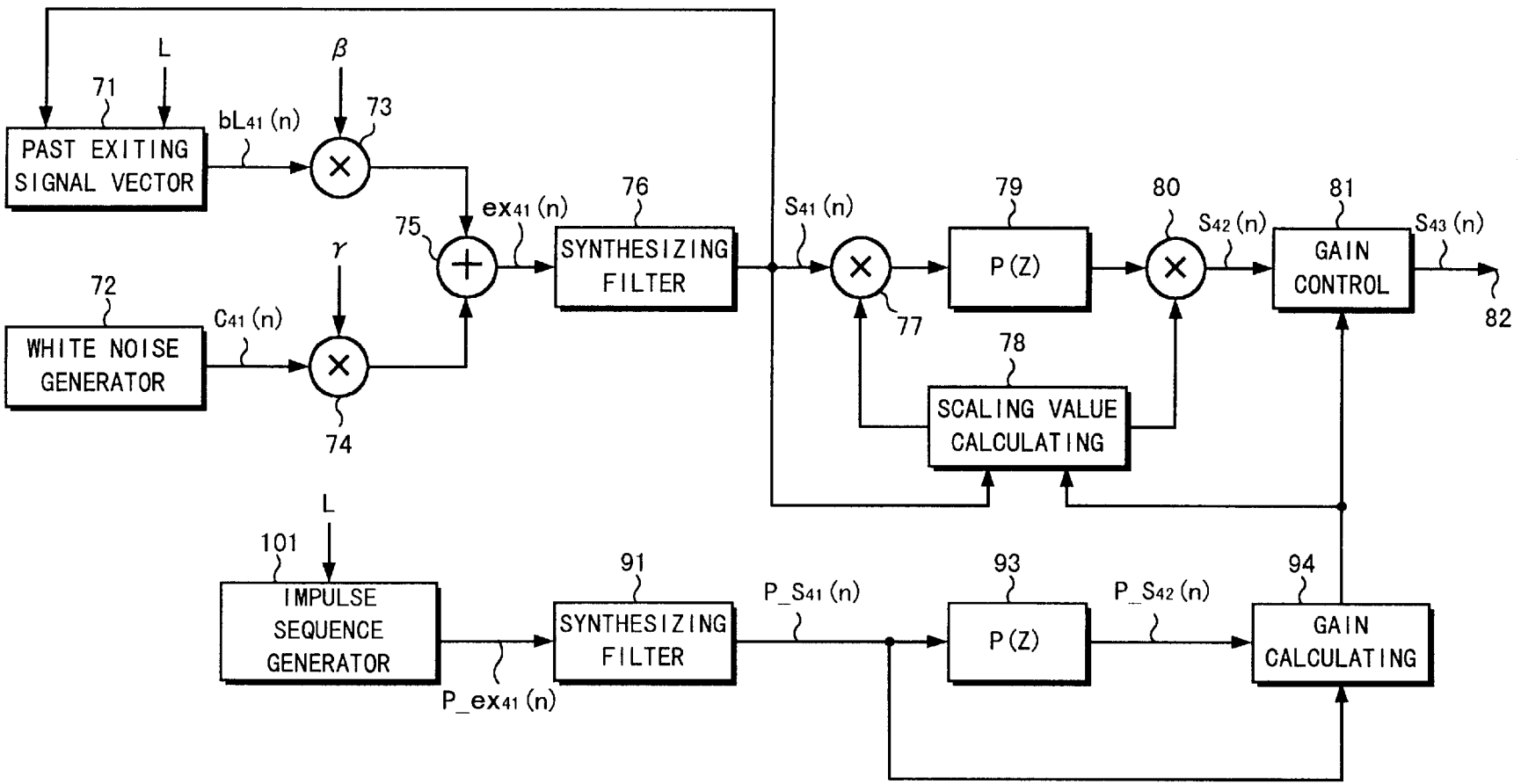
FIG. 10 is a block diagram showing the fifth embodiment of the invention.

As shown in FIG. 10, therefore, it is considered to use an impulse sequence signal $h_{L41}(n)$ based on the pitch information L as a pseudo exciting signal $p_ex_{41}(n)$.

That is, in FIG. 10, the impulse sequence signal $h_{L41}(n)$ based on the pitch information L is generated from an impulse sequence generator 101. The impulse sequence signal $h_{L41}(n)$ is supplied to the synthesizing filter 91. An output of the synthesizing filter 91 is supplied to the post filter 93 and to the gain calculating circuit 94. An output of the post filter 93 is supplied to the gain calculating circuit 94.

The gain calculating circuit 94 calculates a gain of the post filter 93 from a value that is proportional to the input signal vector of the post filter 93 and a value that is proportional to the output signal vector of the post filter 93. The gain obtained by the gain calculating circuit 94 is supplied to the scaling value calculating circuit 78. Thus, the scaling when the filtering operation is performed by the post filter 79 is optimally executed. The gain obtained by the gain calculating circuit 94 is supplied to the gain control circuit 81. The gain fluctuation of the post filter 79 is compensated by the gain control circuit 81.

Figure 11:
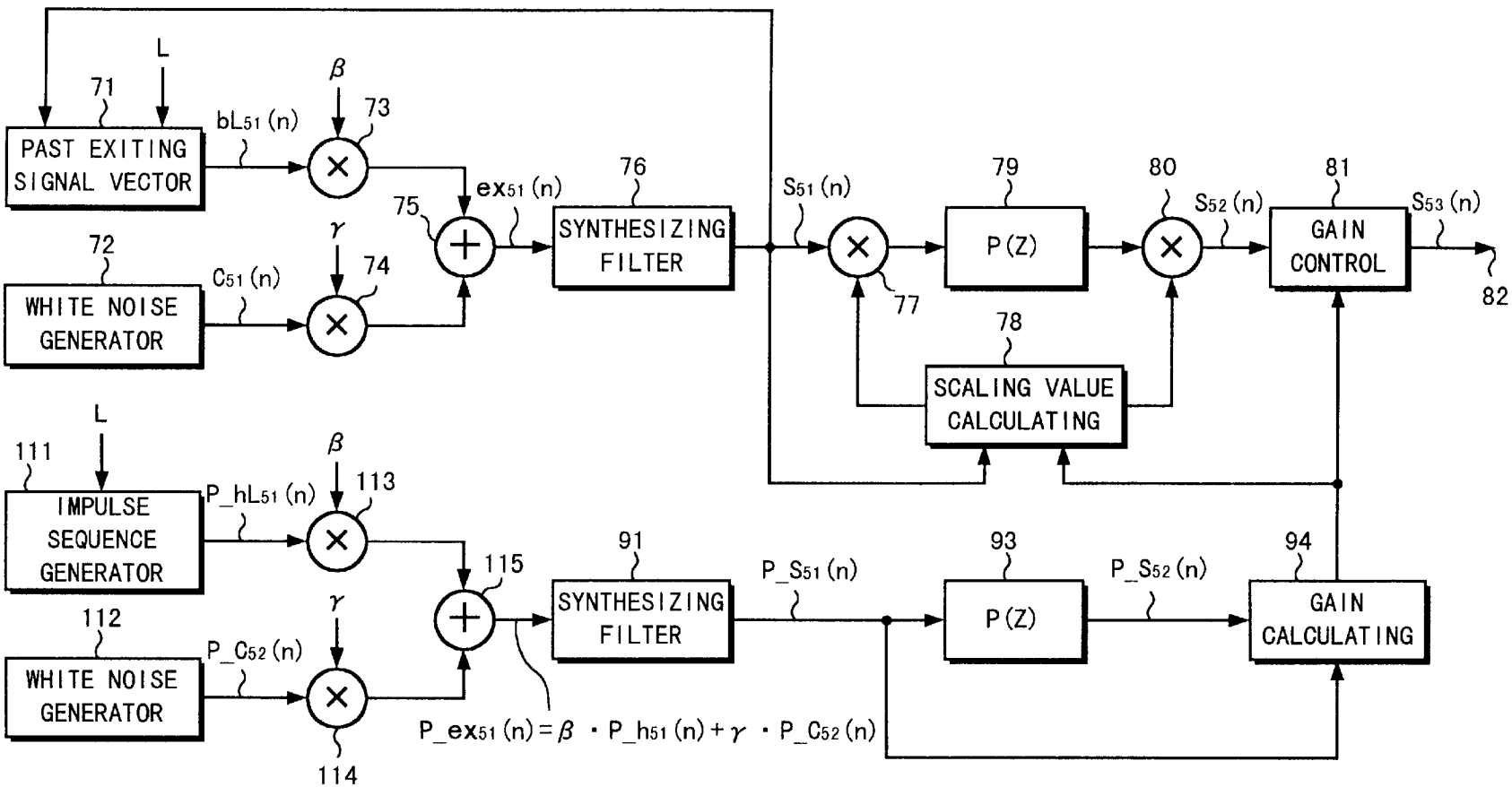
FIG. 11 is a block diagram showing the sixth embodiment of the invention.

As shown in FIG. 11, as a pseudo exciting signal $p_ex_{51}(n)$, it is considered to use a linear sum of the sound/soundless information (β, γ) of an impulse sequence signal $p_h_{L51}(n)$ based on the pitch information L and a noise signal $p_c_{51}(n)$.

That is, in FIG. 11, the impulse sequence signal $p_h_{L51}(n)$ based on the pitch information L is generated from an impulse sequence generator 111. The impulse sequence signal $p_h_{L51}(n)$ is supplied to a multiplier 113 for being multiplied with the gain β. An output of the multiplier 113 is supplied to an adder 115. A noise signal $p_c_{52}(n)$ is generated from a white noise generator 112. A noise signal $p_c_{52}(n)$ is supplied to a multiplier 114 for being multiplied with the gain γ. An output of the multiplier 114 is supplied to the multiplier 115.

A linear sum of the sound/soundless information (β, γ) of the impulse signal $p_h_{L51}(n)$ based on the pitch information L and the noise signal $p_c_{52}(n)$ is obtained by the adder 115 and the pseudo exciting signal $p_ex_{51}(n)$ is obtained by $$p_ex_{51}(n)=\beta\cdot(p_h_{L51}(n))+\gamma\cdot(p_c_{52}(n))$$

The pseudo exciting signal $p_ex_{51}(n)$ formed as mentioned above is supplied to the synthesizing filter 91.

An output of the synthesizing filter 91 is supplied to the post filter 93 and to the gain calculating circuit 94. An output of the post filer 93 is supplied to the gain calculating circuit 94. The gain of the post filter 93 is calculated by the gain calculating circuit 94. The gain obtained by the gain calculating circuit 94 is supplied to the scaling value calculating circuit 78. Thus, the scaling when the filtering operation is performed in the post filter 79 is optimally executed. The gain obtained by the gain calculating circuit 94 is supplied to the gain control circuit 81. The gain fluctuation of the post filter 79 is compensated by the gain control circuit 81.

It is considered that the pitch position of the impulse sequence of the pitch period based on the pitch information P is synchronized with the pitch position of the exciting signal vector. The pitch position can be coarsely known by searching the peak of the exciting signal vector.

Figure 12:
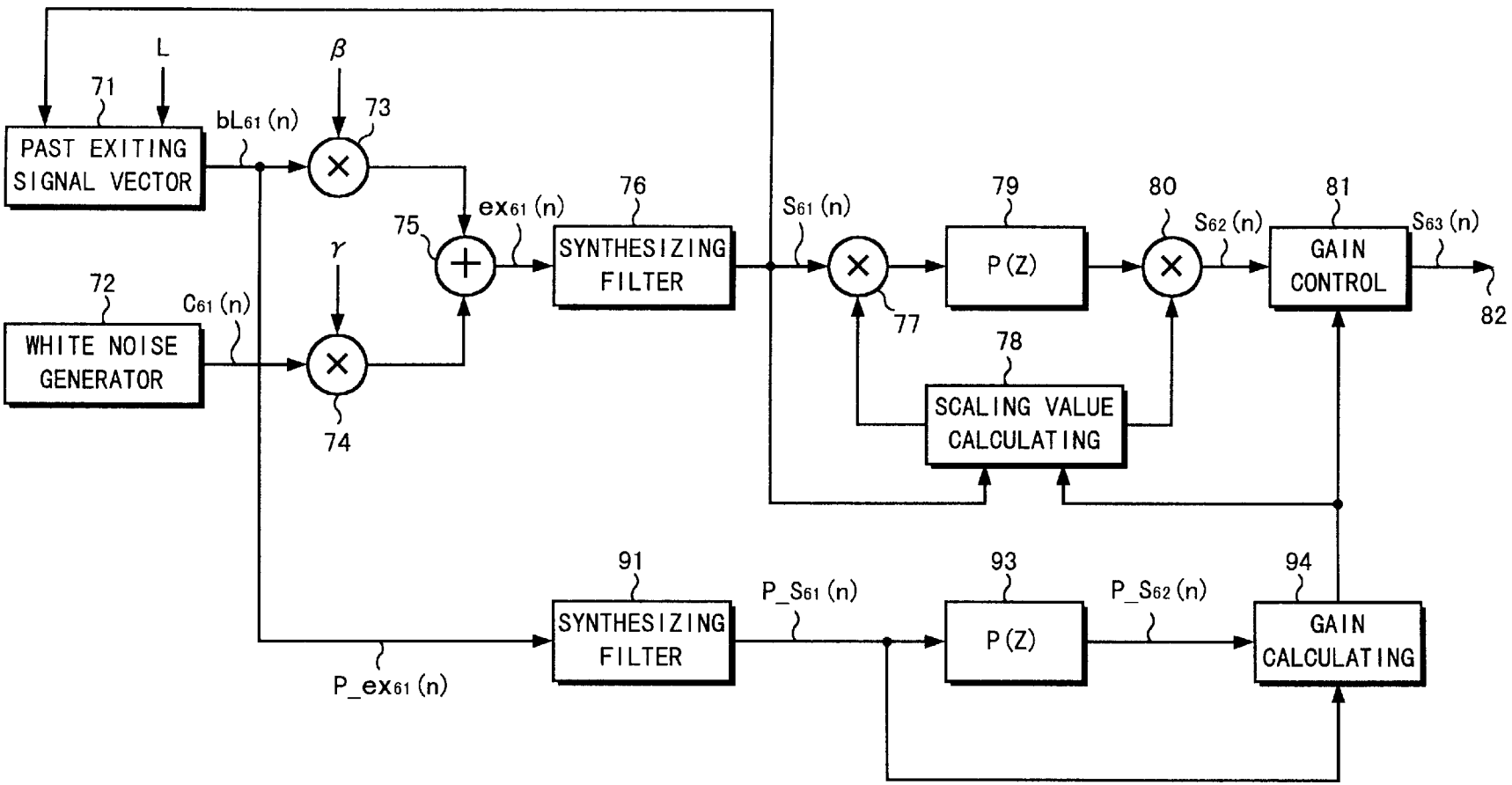
FIG. 12 is a block diagram showing the seventh embodiment of the invention.

Further, as shown in FIG. 12, it is considered that a signal $b_{L61}$ which is based on the pitch information L and the past exciting signal vector state and is generated from the signal generator 71 is used as a pseudo exciting signal $p_ex_{61}(n)$.

That is, in FIG. 12, the signal $b_{L61}(n)$ which is based on the pitch information L and the past exciting signal vector state and is generated from the signal generator 71 is supplied as a pseudo exciting signal $p_ex_{61}(n)$ to the synthesizing filter 91. An output of the synthesizing filter 91 is supplied to the post filter 93 and to the gain calculating circuit 94. An output of the post filter 93 is supplied to the gain calculating circuit 94. The gain of the filter 93 is calculated by the gain calculating circuit 94. The gain obtained by the gain calculating circuit 94 is supplied to the scaling value calculating circuit 78. Thus, the scaling when the filtering operation is executed in the post filter 79 is optimally performed. The gain obtained by the gain calculating circuit 94 is supplied to the gain control circuit 81. The gain fluctuation of the post filter 79 is compensated by the gain control circuit 81.

Figure 13:
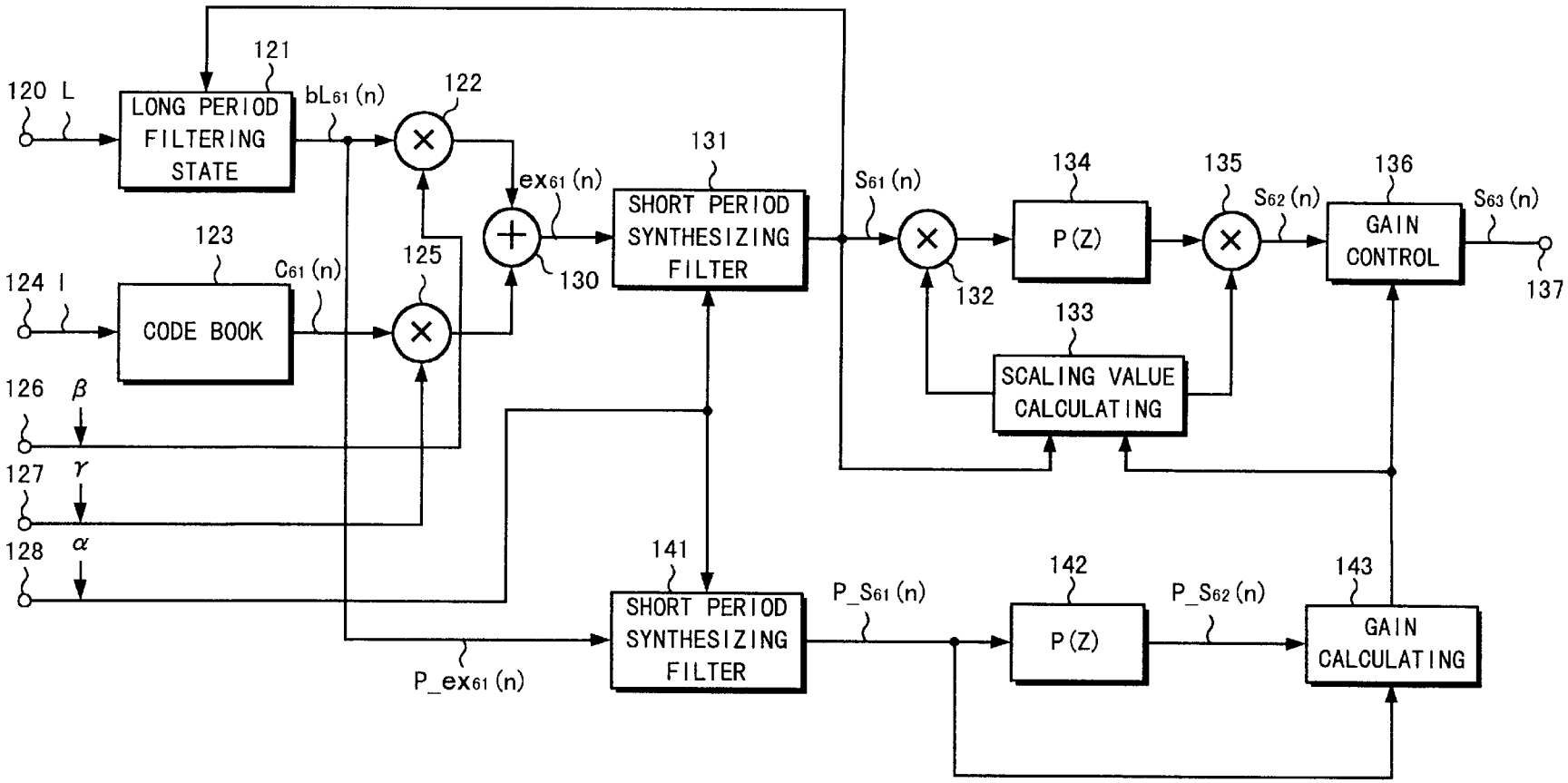
FIG. 13 is a block diagram showing an example of a VSELP demodulator to which the invention is applied.

FIG. 13 shows an example in which a decoder of the VSELP is realized in consideration of the above study. In FIG. 13, reference numeral 121 denotes a long period filtering state. The past exciting vector is supplied to the long period filtering state 121 and the received pitch information L is also supplied to an input terminal 120. The long period filtering state 121 forms the signal $b_{L61}(n)$ based on the received pitch information L and the past exciting signal vector state. The formed signal $b_{L61}(n)$ is supplied to a multiplier 122.

Reference numeral 123 denotes a code book. The exciting source code I received is supplied from an input terminal 124 to the code book 123. A basic vector is added by the code book 123 on the basis of the exciting source code I and a noise signal $c_{61}(n)$ is formed. The noise signal $c_{61}(n)$ is supplied to a multiplier 125.

The gain β received is supplied from an input terminal 126 to the multiplier 122. The gain γ received is supplied from an input terminal 127 to the multiplier 125. The gain β is multiplied with the signal $b_{L61}(n)$ by the multiplier 122. The gain γ is multiplied with the noise signal $c_{61}(n)$ by the multiplier 125.

Outputs of the multipliers 122 and 125 are supplied to an adder 130. An exciting signal vector $ex_{61}(n)$ is formed by the adder 130. The exciting signal vector $ex_{61}(n)$ is expressed by $$ex_{61}(n)=\beta b_{L61}(n)+\gamma c_{61}(n)$$

The exciting signal vector $ex_{61}(n)$ is supplied to a short period synthesizing filter 131 and is fed back to the long period filtering state 121.

The parameter α is supplied from a terminal 128 to the short period synthesizing filter 131. The audio signal is synthesized by the short period synthesizing filter 131. The synthesized audio signal is supplied to a shifting circuit 132. The shifting circuit 132 shifts the synthesized audio signal on the basis of the scaling value from a scaling value calculating circuit 133. An output of the shifting circuit 133 is supplied to a post filter 134.

The post filter 134 executes a process to improve a sound quality. The post filer 134 executes the filtering operation to the signal from the short period synthesizing filter 131. The filtering operation in the post filter 134 is realized by a fixed point arithmetic operation. An output of the post filter 134 is supplied to a shifting circuit 135. The shifting circuit 135 shifts the input signal in accordance with the shift amount in the shifting circuit 132 in the reverse direction of the shifting direction. An output of the shifting circuit 135 is supplied to a gain control circuit 136. The gain control circuit 136 compensates a gain fluctuation caused by the post filter 134. An output of the gain control circuit 136 is outputted as a decoding signal from an output terminal 137.

The signal $b_{L61}(n)$ from the long period filtering state 121 is supplied as a pseudo exciting signal $p_ex_{61}(n)$ to a short period synthesizing filter 141. The parameter α is supplied from the terminal 128 to the short period synthesizing filter 141. The short period synthesizing filter 141 is constructed in a manner similar to the short period synthesizing filter 127.

An output $p_s_{61}(n)$ of the short period synthesizing filter 141 is supplied to a post filter 142 and to a gain calculating circuit 143. An output of the post filter 142 is supplied to the gain calculating circuit 143. The post filter 142 has characteristics similar to those of the post filter 134.

The input signal vector $p_s_{61}(n)$ of the post filter 142 and an output signal vector $p_s_{62}(n)$ of the post filter 142 are supplied to the gain calculating circuit 143. The gain calculating circuit 143 calculates a gain by the post filter 142 from a value that is proportional to the input signal vector $p_s_{61}(n)$ of the post filter 142 and a value that is proportional to the output signal vector $p_s_{62}(n)$ of the post filter 142.

The gain obtained by the gain calculating circuit 143 is supplied to the scaling value calculating circuit 133. Thus, the scaling when the filtering operation is executed in the post filter 134 is optimally performed. The gain obtained by the gain calculating circuit 143 is supplied to the gain control circuit 136. The gain fluctuation caused by the post filter 134 is compensated by the gain control circuit 136.

In the above example, although the case of mainly using the VSELP as a compressing system has been described, the invention can be also similarly applied to the other compressing systems.

According to the invention, another post filter having characteristics similar to those of the post filter for processing the demodulated audio signal is prepared and the gain of the post filter to process the audio signal can be previously presumed by the post filer. Therefore, the optimum scaling can be executed when the filtering operation in the post filter is performed by the fixed point arithmetic operation. By using the gain obtained as mentioned above, the gain fluctuation occurring by the post filter can be optimally corrected.

The present invention is not limited to the foregoing embodiments but many modifications and variations are possible within the spirit and scope of the appended claims of the invention.

What is claimed is:

1. A digital signal processing apparatus comprising:

first filter means having predetermined characteristics for performing a filtering operation on an input signal;

second filter means having characteristics similar to said characteristics of said first filter means;

gain calculating means for obtaining a gain of said second filter means based on a pseudo input signal fed to said second filter means and an output signal thereof;

scaling means for performing a scaling process to the filtering operation in said first filter means; and gain control means for receiving an output of said first filter means and correcting a gain fluctuation caused by said first filter means, wherein a scaling value of said scaling means and a gain correction value of said gain control means are controlled by using the gain of said second filter means from said gain calculating means.

2. A digital signal processing apparatus comprising:

first synthesizing filter means having predetermined characteristics for synthesizing an audio signal from an exciting signal;

first post filter means having predetermined characteristics for filtering an output of said first synthesizing filter means;

second synthesizing filter means having characteristics similar to said characteristics of said first synthesizing filter means for synthesizing a pseudo audio signal from a pseudo exciting signal;

second post filter means having characteristics similar to said characteristics of said first filter means for filtering an output of said second synthesizing filter means;

gain calculating means for obtaining a gain of said second filter means from an input signal fed to said second filter means and an output signal thereof;

scaling means for performing a scaling process to a filtering operation in said first post filter means; and gain control means receiving an output of said first filter means for correcting a gain fluctuation caused by said first post filter means, wherein a scaling value of said scaling means and a gain correction value of said gain control means are controlled by using the gain of said second post filtering means from said gain calculating means.

3. A gain correcting method of a digital signal processing apparatus, comprising the steps of:

supplying an input signal to a first filter of known characteristics for performing a filtering operation;

supplying a pseudo input signal to a second filter having characteristics similar to said characteristics of said first filter and executing a filtering operation thereon;

obtaining a gain of said second filter by performing a gain calculation on said pseudo input signal of said second filter and an output signal thereof;

performing a scaling process by scaling the filtering operation in said first filter by using the calculated gain of said second filter; and correcting a gain fluctuation caused by said first filter by a gain control circuit receiving an output of said first filter by using the calculated gain of said second filer means filter.

4. A gain correcting method of a digital signal processing apparatus, comprising the steps of:

inputting an exciting signal to a first synthesizing filter having known characteristics;

supplying an audio signal synthesized by said first synthesizing filter to a first post filter having known characteristics for performing a filtering operation thereon;

inputting a pseudo exciting signal to a second synthesizing filter having characteristics similar to said characteristics of said first synthesizing filter;

supplying a pseudo audio signal synthesized by said second synthesizing filter in response to a pseudo exciting signal to a second post filter having characteristics similar to said characteristics of said first post filter and performing a filtering operation thereon;

obtaining a gain of said second post filter by calculating the gain based on an input signal to said second post filter and an output signal thereof;

performing a scaling process by scaling the filtering operation in said first post filter by using the calculated gain of said second post filter; and correcting a gain fluctuation caused by said first post filter by a gain control circuit receiving an output of said first post filter by using the calculated gain of said second post filter.

5. The method according to claim 4, comprising the further step of providing said first and second synthesizing filters constructed as linear predictive coefficient filters.

6. The method according to claim 4, comprising the further step of providing said first and second synthesizing filters constructed as partial autocorrelation coefficient filters.

7. The method according to claim 4, comprising the further step of providing said first and second synthesizing filters constructed as linear spectrum pair filters.

* * * * *